US005128589A

United States Patent [19]

Dakin

[11] Patent Number: 5,128,589

[45] Date of Patent: Jul. 7, 1992

[54] HEAT REMOVING MEANS TO REMOVE HEAT FROM ELECTRIC DISCHARGE LAMP

[75] Inventor: James T. Dakin, Shaker Heights, Ohio

[73] Assignee: General Electric Company, Schenectady, N.Y.

[21] Appl. No.: 597,636

[22] Filed: Oct. 15, 1990

[51] Int. Cl.[5] ..... H01J 7/12; H01J 7/24; H01J 61/22; H01J 61/52

[52] U.S. Cl. ..... 313/634; 313/642; 313/17; 313/26; 313/46; 313/44; 313/113; 362/296

[58] Field of Search ..... 313/634, 44, 17, 26, 313/46, 642, 113; 362/296

[56] References Cited

U.S. PATENT DOCUMENTS

| | | | |
|---|---|---|---|
| 3,087,083 | 4/1963 | Katz | 313/44 |
| 4,600,857 | 7/1986 | Suhar | 313/44 X |
| 4,935,668 | 6/1990 | Hansler et al. | 313/634 X |

*Primary Examiner*—Donald J. Yusko
*Assistant Examiner*—Ashok Patel
*Attorney, Agent, or Firm*—George E. Hawranko; Stanley C. Corwin; Fred Jacob

[57] ABSTRACT

Heat transfer means are disclosed to remove heat from a fused quartz arc tube being employed as the light source in an electric discharge lamp. The heat removal is carried out during lamp operation with a fused quartz protuberance that cooperates to remove heat being conducted through the arc tube walls. Various lamp embodiments are disclosed whereby such fused quartz protuberance is physically disposed adjacent the hot spot region of the arc tube in a xenon-metal halide lamp.

7 Claims, 2 Drawing Sheets

HEAT REMOVING MEANS TO REMOVE HEAT FROM ELECTRIC DISCHARGE LAMP

BACKGROUND OF THE INVENTION

This invention relates generally to means for heat removal from the fused quartz arc tube of an electric discharge lamp and more particularly, to such means being utilized for lamp operation at relatively high temperatures and discharge pressures.

Various high pressure type electric discharge lamps commonly employ a fused quartz arc tube as the light source by reason of the refractory nature and optical transparency of this ceramic material. In such type lamps the arc tube generally comprises a sealed envelope formed with fused quartz tubing with discharge electrodes being hermetically sealed therein. A typical arc tube construction hermetically seals a pair of discharge electrodes at opposite ends of the sealed envelope, although it is also known to have both electrodes being sealed at the same end of the arc tube. The sealed arc tube further contains a fill of various metal substances which becomes vaporized during the discharge operation to include mercury, sodium and metal halides along with one or more inert gases such as krypton, argon and xenon. Operation of such metal vapor discharge lamps can be carried out with various already known lamp ballasting circuits employing both alternating current and direct current power sources. High luminous efficacy is achieved with these type metal vapor lamps with the new lamp designs increasing such efficacy by increasing discharge pressures while also reducing lamp envelope size.

Lot spot wall temperatures of about 1000° C. are frequently reached by the quartz arc tube in such lamps at the relatively high operating temperatures and pressures being employed. The fused quartz material can undergo rapid diversification or crystallization in such pressurized thermal environment thereby seriously limiting lamp life by rupture. Upon such an occurrence, the high pressure within a lamp may further cause materials from the quartz tube to become further dislodged at a relatively high velocity possibly fracturing even the outer housing means for the lamp such as employed in an automotive headlamp application. In product applications wherein the quartz arc tube is positioned within a reflector member, such as in automotive headlamps and still other product applications, any bulging of the arc tube caused by exposure to such elevated pressure and temperature conditions can adversely affect the desired illumination pattern. There is a serious need, therefore, to reduce hot spot wall temperatures being experienced during lamp operation.

Accordingly, it is an object of the present invention to provide means to remove heat from a fused quartz arc tube being employed in an electric discharge lamp.

Another object of the present invention is to provide an electric discharge lamp employing a fused quartz arc tube which includes particular heat transfer means operatively associated with said arc tube to remove heat being conducted through the arc tube walls.

Still a further object of the present invention is to utilize a fused quartz medium for heat removal from an electric discharge lamp.

It is a still further object of this invention to provide an automotive headlamp employing a fused quartz arc tube as the light source which includes heat removal means operatively associated with said arc tube.

These and other object of the present invention will become apparent upon considering the following more detailed description.

SUMMARY OF THE INVENTION

The present invention is directed generally to means for heat removal from a fused quartz arc tube serving as the light source in various electric discharge lamps. The heat is removed through the arc tube walls by means of a fused quartz protuberance which is physically disposed adjacent to the hot spot region of the arc tube. Such fused quartz protuberance may be produced in one wall of the arc tube itself when initially formed in the conventional manner. Alternately, a suitable protuberance can be provided in one wall of the quartz arc tube by means of heat sealing or adhesively bonding to its outer wall surface a small nodule of fused quartz. In another embodiment, the fused quartz protuberance may be physically spaced apart from one wall of the arc tube.

DETAILED DESCRIPTION OF THE PREFERRED EMBODIMENTS

Figure 1:
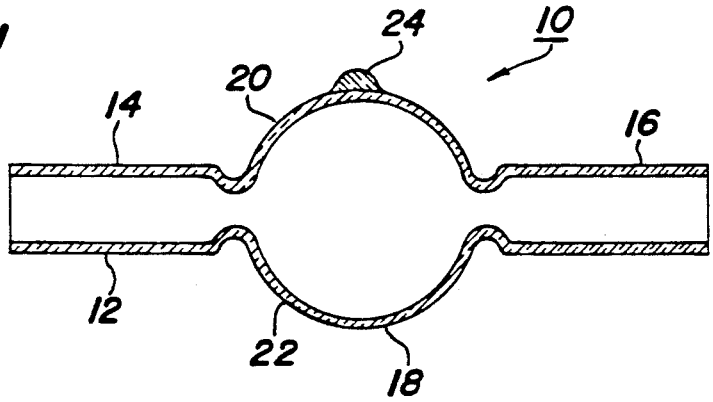
FIG. 1 is a side view partially in cross section depicting a fused quartz envelope shape including heat transfer means according to the present invention.

Referring to the drawings, FIG. 1 depicts a fused quartz envelope 10 prior to its being fabricated into an arc tube suitable for automotive type applications. As shown in the drawing, the envelope shape 10 comprises an elongated hollow body 12, neck portions 14 and 16, and a bulbous shaped central portion 18 formed by wall portions 20 and 22. A fused quartz protuberance 24 has been secured to the outer surface of wall portion 20 in order to provide heat transfer means in accordance with the present invention. The fused quartz protuberance 24 is located at or near the mid-point of the bulbous shaped central portion 18 so as to coincide with the hot spot region experienced by an arc tube during lamp operation. Accordingly, the depicted means for heat removal involves cooperative action between upper wall portion 20 of the fused quartz envelope 10 and said fused quartz protuberance 24. Heat removal proceeds from initial conduction through said wall portion for further collection and dissipation with the provided protuberance element.

Figure 2:
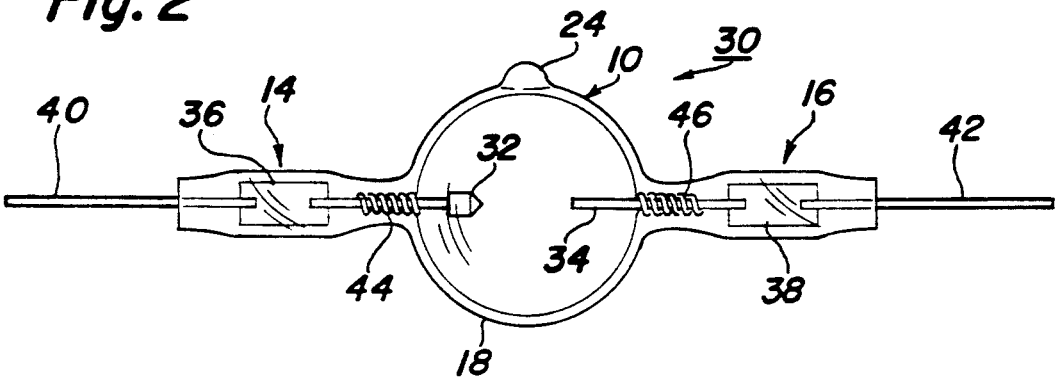
FIG. 2 is a side view depicting an arc tube for a metal halide lamp incorporating the fused quartz envelope of FIG. 1.

In FIG. 2 there is depicted an operable arc tube 30 fabricated in the customary manner with the hollow envelope shape 10 described in the preceding embodiment. Accordingly, the same numerals are retained in the present drawing to identify common elements of said envelope shape 10. The depicted quartz arc tube 30 has a double-ended configuration whereby a pair of electrodes 32 and 34 are hermetically sealed in the neck portions 14 and 16, respectively, of the hollow envelope and separated from each other by a predetermined distance in the range of about two millimeters to about four millimeters. While a double-ended configuration is shown, a single ended arc tube configuration is also contemplated in accordance with the present invention wherein both electrodes are disposed at the same end of the arc tube and separated from each other by a predetermined distance. Electrodes 32 and 34 comprise rod-like members formed with a refractory metal such as a tungsten or tungsten alloys and optionally configured to have dissimilar physical size as shown in the present drawing. Anode electrode 32 is thereby shown to be larger in diameter than cathode electrode 34 for a desirably greater heat dissipation therefrom when operated with a direct current power source, although electrodes of the same size are generally selected for lamp operation with an alternating current power source. The electrode members are preferably also of the already known spot-mode type so as to develop a thermionic arc condition within said arc tube 30 in a substantially instantaneous manner. Both electrodes 32 and 34 are hermetically sealed within the quartz envelope 10 with thin refractory metal foil elements 36 and 38 that are further connected to outer lead wires 40 and 42, respectively. A fill (not shown) of xenon, mercury and a metal halide which is further contained within the bulbous shaped and now sealed cavity 18 of the quartz envelope cooperates in providing the instant light emission. Refractory metal coils 44 and 46 serve to centrally position the electrode members at the ends of the sealed arc tube envelope.

A number of temperature measurements were made upon the arc tube member 30 to determine the effectiveness of the fused quartz protuberance 24 incorporate therein as a means of dissipating heat. The temperature measurements were conducted with the arc tube operating in a lighted condition and were made with a commercial pyrometer device transmitting at about five microns wavelength. Lowering of the arc tube wall temperatures below 1000 C by such heat transfer means was the objective sought in order to reduce the undesirable effects upon lamp performance that have been previously pointed out. Accordingly, wall temperatures of the lighted arc tube were measured at both ends and at the mid-point of the bulbous central portion 18 along with measuring the temperature at the terminal outward projecting end of said quartz protuberance 24. A 995° C. wall temperature was measured at anode end of the sealed cavity while the opposite cathode end of said sealed cavity produced a 910° C. wall temperature. The wall temperature at the mid-point location in the bulbous central portion 18 measured 975° C. whereas the outer terminal end of the quartz protuberance measured 925° C. It is apparent from these temperature measurements that hot spot temperatures have been reduced below the 1000° C. temperature experienced without such heat removal means. A still further reduction in the arc tube operating temperatures was also demonstrated by having additional heat sink means deployed in physical contact with the present heat transfer mechanism. More particularly, an 18 gauge heat conducting metal wire (not shown in the FIG. 2 drawing) was simply bent around the base of said quartz protuberance 24 with comparable temperature measurements being thereafter made upon such modified heat transfer means during arc tube operation. The anode wall temperature now measured 930° C., the cathode wall temperature now measured 875° C., the mid-point wall temperature now measured 920° C. and the terminal end of the quartz protuberance now measured 820° C. The above demonstrated reduction in hot spot temperatures during lamp operation should further desirably promote achieving a more uniform wall temperature distribution in the arc tube.

Figure 3:
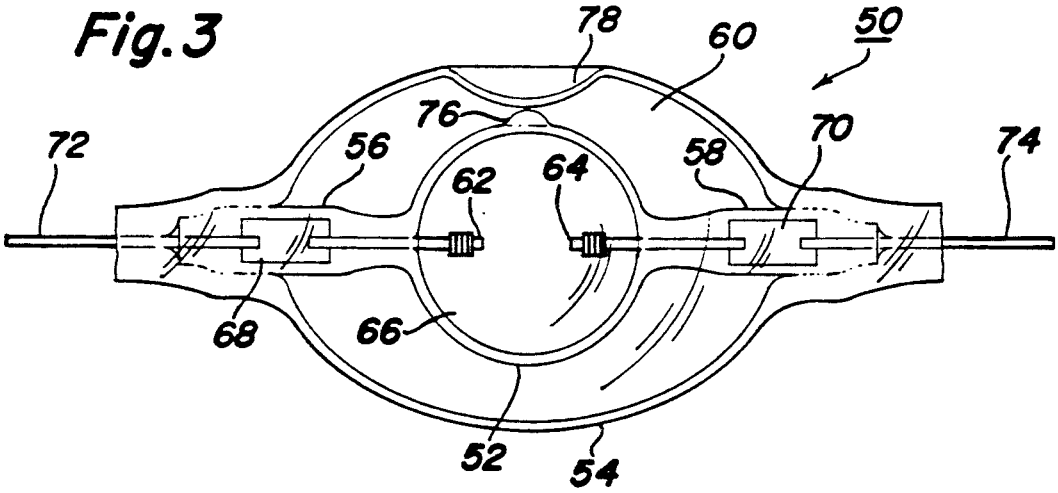
FIG. 3 is a side view depicting a different quartz arc tube construction according to the present invention.

FIG. 3 is a side view depicting a quartz arc tube construction 50 for a metal halide lamp having an inner fused quartz arc tube member 52 merged with an outer envelope or shroud member 54 at the neck portions 56 and 58 of the arc tube member. A more detailed explanation of the purposes served in providing a metal halide lamp with generally similar shroud means can be found in commonly assigned U.S. Pat. No. 4,935,668, issued to R. L. Hansler et al. As can be seen in the present drawing, the shroud member is physically separated from the walls of the inner arc tube member by a predetermined distance to provide a sealed annular space 60 therebetween. Since the shroud member 54 also operates at a lower temperature than experienced by the arc tube during lamp operation, a less refractory optically transparent glass such as #180 glass may be used for its construction. Employment of such an outer shroud member has several advantages. It serves to minimize cooling effects of gas conduction and convection within the quartz arc tube for improved uniform temperature operation in the lamp whereby more metal halide is vaporized and maintained in the discharge of the arc condition within the inner arc tube which improves the efficiency and color of the light source. Such improved uniform temperature operation also makes the light source less dependent on its orientation within a housing such as within an automotive headlamp. The shroud member also reduces the typically occurring cataphoresis effects during the DC and low frequency operation of the light source which drive the metal halide out of the ends of the light source. The sealed annular space 60 is preferably evacuated but can also be filled with dry nitrogen and water gettering agents such as chips of zirconium metal. The arc tube construction herein employed is again of the double-ended type having electrodes 62 and 64 hermetically sealed at opposite ends of a bulbous central cavity 66. Similarly, electrodes 62 and 64 are connected to thin refractory metal foil elements 68 and 70, respectively, with the opposite ends of said foil elements being connected to respective outer lead conductors 72 and 74. As further shown in FIG. 3, both rod-like electrodes 62 and 64 have the same configuration and physical size. Of course, the electrodes can be of different size, as shown in FIG. 2. A fused quartz protuberance 76 is secured to an outer wall surface of the quartz arc tube 52 at or near the mid-point of the bulbous central cavity 66 to serve the presently employed heat transfer means. The quartz protuberance cooperates with a second protuberance or dimple 78 provided in the outer vitreous shroud member 54 to effect still further heat removal. In achieving the desired cooperation, quartz protuberance 76 is disposed adjacent the second protuberance 78 in a spaced apart relationship. Since the outer shroud member 54 itself participates in desirably removing heat from the inner arc tube, the second protuberance 78 provided therein can also be eliminated with only minimum reduction in heat removal. The depicted arc tube construction further includes the customary fill of xenon, mercury and a metal halide (not shown) in providing the desired light emission. Still greater heat removal can also be achieved in arc tube 50 upon physically joining quartz protuberance 76 directly to quartz protuberance 78.

Figure 4:
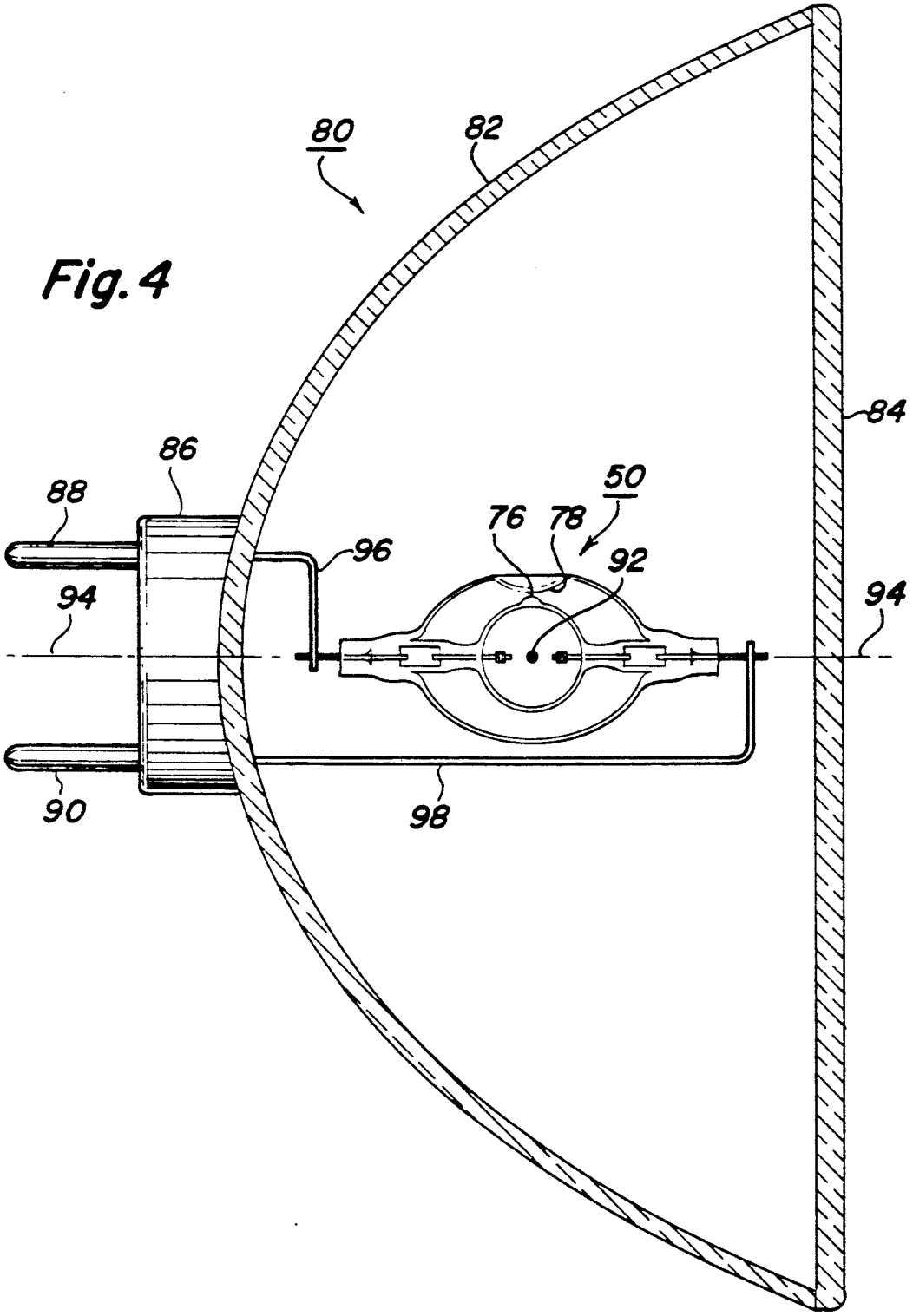
FIG. 4 is a side view of an automotive headlamp incorporating the quartz arc tube of FIG. 3 oriented horizontally.

FIG. 4 is a side view depicting an automotive headlap incorporating the quartz arc tube construction of FIG. 3 oriented in a horizontal axial manner. Accordingly, the automotive headlamp 80 comprises a reflector member 82, a lens member 84 secured to the front section of said reflector member, connection means 86 secured at the rear section of said reflector member for connection to a power source and the metal halide light source 50. Connection means 86 of the reflector member includes prongs 88 and 90 which are capable of being connected to an external power source of an automotive. The reflector member 82 has a predetermined focal point 92 as measured along the axis 94 of the automotive headlamp 80 and the light source 50 is predeterminently positioned within the reflector 82 so as to be approximately disposed at the focal point 92 of the reflector. For the presently illustrated embodiment, the light source 50 is oriented along axis 94 of the reflector. The reflector cooperates with the light source 50 by reason of its parabolic shape and with lens member 84 affixed thereto being of a transparent material which can include prism elements (not shown) also cooperating to provide a predetermined forward projecting light beam therefrom. Light source 50 is connected to the rear section of reflector 82 by a pair of relatively stiff self-supporting lead conductors 96 and 98 which are further connected at the opposite ends to the respective prong elements 88 and 90. Thus connected, light source 50 provides instant illumination when excited from the automotive power source being applied across the spaced apart electrodes whereupon the fill of xenon gas contained within the quartz arc tube becomes first excited followed by vaporization and ionization of the mercury along with the metal halide ingredients further contained therein. By inclusion of heat transfer elements 76 and 78 in the light source according to the present invention, the lamp operating temperature is again held below the desired limit of 1000° C.

It will be apparent from the foregoing description that particular means have been provided to effectively remove heat from a fused quartz arc tube when employed in an electric discharge lamp being operated at relatively high temperatures and pressures. It will also be apparent that significant further modification can be made in physical features of the heat removal means herein disclosed, however, without departing from the true spirit and scope of the present invention. Configurations of a fused quartz arc tube, electrode members and reflector lamp designs other than illustrated herein are also contemplated. For example, a single-ended quartz arc tube can employ the same heat transfer means herein disclosed with comparable beneficial results. Having the heat removal means limited to a dimpled contour projecting inwardly from a vitreous jacket surrounding the quartz arc tube is also contemplated. In addition, an automotive headlamp construction having the light source aligned transverse to the lamp axis and which includes the present heat removal means is also contemplated. Consequently, it is intended to limit the present invention only by the scope of the appended claims.

What I claim as new and desire to secure by Letters Patent of the United States is:

1. Heat transfer means for heat removal from an electric discharge lamp during lamp operation comprising in combination:

(a) a fused quartz arc tube having a hollow cavity formed with hermetically sealed walls, (b) a fused quartz protuberance operatively associated with said arc tube to remove heat being conducted through the walls of said arc tube, and (c) the fused quartz protuberance being disposed adjacent the hot spot region of the arc tube.

2. The heat transfer means of claim 1 wherein the fused quartz protuberance is provided in one wall of the arc tube when initially formed.

3. The heat transfer means of claim 1 wherein the fused quartz protuberance is physically joined to one wall of the arc tube by heat sealing means.

4. The heat transfer means of claim 1 wherein the fused quartz protuberance is provided in an optically transparent vitreous jacket surrounding the fused quartz arc tube and cooperating in heat removal therefrom.

5. The heat transfer means of claim 4 wherein a protuberance formed in the wall of the arc tube cooperates with the protuberance formed in the vitreous jacket.

6. An automotive headlamp which comprises:

(a) a reflector member for connection to a power source, said reflector having a predetermined focal length and focal point, (b) a lens member joined to the front section of said reflector, and (c) a fused quartz arc tube predeterminently positioned within said reflector so as to be approximately disposed adjacent the focal point of said reflector the fused quartz arc tube having a hollow cavity formed with walls hermetically sealing a pair of discharge electrodes therein and containing a fill of xenon at a relatively high pressure, mercury and a metal halide, said arc tube further including a fused quartz protuberance operatively associated with said arc tube to remove heat being conducted through the walls of said arc tube, and the fused quartz protuberance being disposed adjacent the hot spot region of said arc tube.

7. A metal-halide electric discharge lamp having a heat transfer arrangement for heat removal during lamp operation, said discharge lamp comprising:

(a) a fused quartz arc tube having a hollow cavity with walls hermetically sealing a pair of discharge electrodes therein and containing within said cavity, a fill of gas excitable to a discharge state upon the introduction of electrical energy to said discharge electrodes;

(b) a fused quartz proturberance formed on a portion of said arc tube and being effective such that, during operation of said discharge lamp, said fused quartz proturberance removes heat being conducted through said walls of said arc tube, said proturberance being formed so as to have substantially the same light transmissive properties as said arc tube; and (c) wherein said fused quartz protuberance is formed on said arc tube at a position adjacent the hot spot region of said arc tube.

* * * * *